US005309738A

United States Patent [19]

Morris

[11] Patent Number: 5,309,738

[45] Date of Patent: May 10, 1994

[54] YARN FEEDING SYSTEM FOR HIGH SPEED KNITTER

[75] Inventor: Paul H. Morris, Lincoln, Nebr.

[73] Assignee: The Goodyear Tire & Rubber Company, Akron, Ohio

[21] Appl. No.: 58,724

[22] Filed: May 7, 1993

[51] Int. Cl.[5] ..... D04B 15/48; D04B 1/22

[52] U.S. Cl. ..... 66/132 T; 66/9 A; 242/47.13; 156/393

[58] Field of Search ..... 66/125 R, 132 R, 132 T, 66/9 A, 9 R, 8; 242/47.01, 47.13; 264/103, 167; 28/101, 102, 175; 156/393

[56] References Cited

U.S. PATENT DOCUMENTS

| | | | |
|---|---|---|---|
| 88,888 | 4/1869 | Mayall | 156/393 |
| 1,972,756 | 9/1934 | Blaesdell | 66/9 A X |
| 2,732,884 | 1/1956 | Vanzo | 156/393 |
| 3,201,954 | 8/1965 | Grelzin | 66/9 A X |
| 3,855,821 | 12/1974 | Sterpra | 66/132 T |
| 3,901,052 | 8/1975 | Jacobsson | 66/132 T X |

FOREIGN PATENT DOCUMENTS

| | | | |
|---|---|---|---|
| 2009485 | 6/1970 | France | 66/132 T |
| 46-17344 | 5/1971 | Japan | 66/9 A |
| 73-20431 | 6/1973 | Japan | 66/9 A |
| 2009844 | 6/1992 | World Int. Prop. O. | 156/393 |

*Primary Examiner*—Clifford D. Crowder
*Assistant Examiner*—John J. Calvert
*Attorney, Agent, or Firm*—T. P. Lewandowski

[57] ABSTRACT

A system for feeding a plurality of strands of material such as yarn, in unison, along an array of separate feed paths that extend from a bank of supply packages to a knitter head utilizes a bank of positive drive units that are arranged in an array that extends about the knitter head to coordinate and uniformly tension such strand reaches as extend from the positive drive units to the knitter head. The feeding of the strands takes place while the bank of supply packages, the bank of positive drive units, the knitter head and the array of feed paths all are rotated about an axis that extends substantially centrally among the rotating feed paths. Each feed path has a first reach that extends from a separate supply package to the capstan of a separate one of the positive drive units, a second reach that is wrapped around the capstan of its positive drive unit, and a third reach that extends from its positive drive unit to the knitter head. The capstans of the positive drive units are power driven, rotate in unison, and tension the first reaches as is required to pay out the strands from their supply packages. Because the second reaches wrap tautly about the capstans of the positive drive units and rotate therewith at uniform speed, the third reaches are fed to the knitter head at a selected uniform feed rate and under substantially uniform tension regardless of such variations in tension as may be imparted to the first reaches as they are payed from their supply packages.

29 Claims, 5 Drawing Sheets

YARN FEEDING SYSTEM FOR HIGH SPEED KNITTER

BACKGROUND OF THE INVENTION

1. Field of the Invention

The present invention relates generally to the use of a plurality of positive drive units that are operated in unison to feed a plurality of strands of material such as yarn along an array of feed paths to a workstation at a uniform feed rate that can be controlled independently of a selected speed at which the array of feed paths is being rotated about a center axis that extends through the workstation. More particularly, the present invention relates to a system for reliably, continuously and uniformly feeding a plurality of strands such as yarn to the knitter head of a high speed knitter by utilizing positive drive units that are arranged in an array that extends about a center axis of the knitter head's workstation to assist in defining a set of strand feed paths that is rotatable at a selected first speed of rotation about the center axis together with a bank of strand supply packages, with the positive drive units having capstans about which the strands are wrapped, and with the capstans being rotated in unison at a second speed of rotation that can be selected independently from the first speed of rotation to pay out stands from their supply packages and to deliver the payed out strands to the workstation at a desired uniform feed rate and at a uniform tension that is isolated from variations in strand tension that occur as strands are payed out from their supply packages, even in the presence of relatively high centrifugal force and windage loads.

2. Prior Art

In the conventional manufacture of reinforced hose of the type used to transport high pressure fluid, one well known process begins with the formation of an "inner tube" or tubular "core" portion of the hose from a material such as rubber. The core is fed lengthwise along a path of travel that extends centrally through what is referred to as the "knitter head" of a knitter machine. As core portions move continuously through the knitter head, a plurality of cam operated knitter needles carry out a series of relative movements to knit strands of material such as yarn to form a tautly fitting web or jacket of reinforcing material about the outer surface of the core.

An additional layer of "outer tube" or "cover" material such as rubber usually is extruded to extend about the strand-reinforced core. In some instances, the covered, strand-reinforced core is again fed through a knitter to apply still another knitted layer or jacket of reinforcing material, whereafter still another layer of cover material such as rubber usually is applied. If rubber is the material that is being used to form the core and cover layers, the covered hose is put through a curing process to complete its manufacture.

The strands that are knitted by the knitter head to form a knitted jacket of reinforcing material at the workstation of the knitter typically include a dozen or more strands of yarn that each are fed along separate feed paths to the workstation from separate supply packages. Suitable guides of various forms are used to define the feed paths, with some guide formations being more complexly configured than others, but with all of the guides being configured to be as readily "threadable" as possible inasmuch as time spent "threading" or "rethreading" a knitter to replace an exhausted yarn supply package or to replace a broken strand of yarn represents machine "down time" that can seriously limit productivity. In the operation of a knitter, minimizing machine "down time" is an objective that probably is second in importance only to the objective of assuring that the strands are properly fed to and knitted by the knitter head so that a product of high quality is produced.

To feed strands of material along an array of feed paths from supply packages to a knitter head, it is necessary to apply sufficient tension to the strands to cause them to pay out from their supply packages and to move along their threaded feed paths. Many knitters rely solely on the cyclic movement of the knitter needles to provide such tension. However, this approach has a number of drawbacks.

One disadvantage that results from utilizing the needles of a knitter to effect the tensioning and feeding of strands from supply packages to a knitter head is that, on average, the tension force that a knitter needle must apply to pay out yarn from its supply package and feed it along a properly threaded feed path is greater than is compatible with the important additional objective of maximizing the service life of the needles and associated components such as the cams and guide members that cooperate with the needles to cause proper needle movement to take place so that a desired knit pattern can be produced with regularity and without waste.

Another disadvantage that results from using the needles of a knitter to effect strand tensioning and feeding is that, as each strand of yarn is fed along its associated feed path, the tension that is experienced by the strand as it pays out from its supply package varies considerably. The extent to which strands tends to resist being payed out from their supply packages and being fed along their threaded feed paths varies erratically from moment to moment, whereby the extremes in magnitude and the rapid variations in magnitude of the tension forces to which the various needles of a knitter are subjected cause undue wear and breakage of knitter components, and can greatly diminish productivity by adding to machine "down time" that is needed to carry out maintenance, repair and rethreading to replace broken strands.

From the viewpoint of providing a high quality product, the uneven feeding of yarn that results from the presence of erratic strand tension forces and uneven strand feeding causes some strand portions to be pulled more tightly than others as the strands are being knitted by the knitter head, with the result being an uneven application of the knitted layer of reinforcing material which can diminish the capability of the resulting hose to properly withstand the transmission therethrough of pressurized fluid for an appropriately lengthy service life. In some instances, variations and distortions appear in the knit pattern that are so significant as to be unacceptable.

Due to the detrimental effects caused by variations in strand tension and strand feed rate, and inasmuch as these detrimental effects tend to become more pronounced the faster that a knitter is operated, the speed at which knitters can be operated continuously and reliably often has had to be slowed to a far greater degree than is desired if good knitter productivity is to be maintained. If too high a speed of production of reinforced hose is attempted, needle breakage, strand breakage and resulting "down time" needed to repair and maintain the knitter, and to replace broken needles and strands is found to diminish rather than to enhance productivity.

While a number of desirable types of knit patterns can be formed in reinforcing material by utilizing a knitter head that does not rotate about a center axis along which a hose core travels as it moves centrally through the knitter head, there are some desirable knit patterns that can be implemented only if there is rotary movement of the knitter head relative to the core as the core moves centrally through the knitter head. Helical knit patterns, for example, can only be produced if relative rotary movement takes place between the knitter head and the core as the core moves centrally through the knitter head.

Because it is almost always impractical, if not impossible, to effect such relative rotary movement by rotating the core about the center axis of the knitter head, the needed relative rotation usually must be obtained by rotating the knitter head and its attendant strand supply and guide system components about a central axis along which the core is fed as it travels centrally through the knitter head. Especially in continuous hose manufacturing processes wherein non-rotatable extrusion equipment is used to form a hose core that is fed to a knitter located downstream from where the core has emerged from the extruder, the only viable option available for producing a helical knit pattern is to rotate the knitter head and its attendant strand supply and guide system components about the path that is followed by the core as it travels centrally through the knitter head.

Rotating the knitter head and its associated strand supply and guide components presents a number of concerns that need to be addressed with care if desirable knitter performance and reasonable productivity are to be obtained. The speed of rotation of strand guide and supply system components and strand feedpaths about the center axis that needs to be achieved if good productivity is to be obtained is desirably in excess of 600 revolutions per minute, with rotational speeds of 600 to 1400 revolutions per minute being preferred. As rotational speed is and the speed at which hose core material is fed through the workstation are increased, the rate at which knitter needles execute their stroke-like cycles of movement also must be increased to more rapidly implement the knitting function they perform.

At supply system rotation speeds of 600 to 1400 revolutions per minute, the knitter needles preferably are operated at a correspondingly high speed that is within the range of about 3000 to about 6000 strokes per minute. However, with previously proposed strand supply and guide system proposals, the desirably high productivity that theoretically can be obtained if rotation of the supply system is increased to within the range of about 600 to about 1400 revolutions per minute has not been attainable, much less maintainable for reasonable lengths of time. The principal limiting factor that has stood as an obstacle has been an inability to suitably feed a rotating array of strands to the knitter head so that a needle stroke rate of between about 3000 to about 6000 strokes per minute not only can be attained but also maintained for lengthy production runs. The erratic tensioning and uneven feeding of strands of yarn to the needles of the knitter has stood as a barrier both due to resulting breakage of needles and strands, and due to the excessive wear and tear that is inflicted on the needles and their associated cam and guide components.

Among the problems that need to be taken into account if knitter heads and their attendant strand supply and guide components are rotated at speeds that are even as high as about 600 revolutions per minute are the resulting centrifugal force and windage loadings that are imposed on not only on the components of the knitter but also on reaches of strand material as they extend along their prescribed feed paths. If the problems that are generated by centrifugal force and windage loadings are added to the problems that are generated by erratic tensioning and uneven feeding of strands to the knitter head, excessive component wear and breakage as well as excessive strand breakage tend to result. Moreover, if proper high speed knitter operation is attempted by also increasing the rate of movement of the knitter needles above about 1000 strokes per minute to somewhere within the range of about 3000 to about 6000 strokes per minute, the problems that stem from erratic tensioning and uneven feeding of strands to the knitter head are exacerbated, with the result being that almost no meaningfully lengthy production runs can be carried out between incidents of "down time" that require machine repair and/or replacement of broken strands. Furthermore, the quality of the resulting product has tended to be unacceptable due to variations and distortions that appear in the knit pattern.

In efforts to overcome the detrimental effects that result if knitter needles, acting alone, are used to pay out strands from supply packages and to feed the strands through guides to the workstation of a knitting machine, a variety of supplemental feeding devices have been proposed that are intended to be installed along strand feed paths to assist knitter needles in tensioning and feeding strands. However, 1) because the operation of a set of supplemental feeding devices must be carefully coordinated to ensure that the strands are fed in unison (i.e., at substantially identical feed rates) to the knitter head, and 2) because the uniform feed rate at which the strands are fed needs to properly accommodate the rate at which the knitter head makes use of strand material to knit a web of reinforcing material about a hose core, proposed supplemental feeding devices typically are relatively complex and expensive.

To the extent that supplemental feeding devices for use with an array of strands being fed to the workstation of a knitter have been proposed, most of the proposals employ components that have not been found to preform reliably and with good longevity of service life in the presence of the significant centrifugal and windage force loadings that result if a knitter head and its strand supply, guide and feed system are rotated at speeds of even as much as 600 revolutions per minute. If rotational speed of supply system components is increased to the more desirable range of about 600 to about 1400 revolutions per minute which is preferred in order to obtain good productivity from a high speed knitter, components and strand reaches that are spaced only a few inches from the axis of rotation easily can be subjected to loadings of force that are hundreds of times their weight. In such circumstances, electrical switch components and the like often are found to develop malfunctions and/or fail to perform as intended. Likewise, it is not unusual to find that even simple mechanical devices that employ relatively movable parts and have proven to be highly reliable when used in stationary environments malfunction and/or fail to perform as intended when subjected to an environment of high speed rotation.

Despite the existence of a longstanding need for a highly reliable system for driving and coordinating the operation of an array of supplemental feeding devices that are installed along a rotating array of strand feed paths to appropriately reduce the tension forces that strands exert on knitter needles, no suitably simple and reliable mechanical, electrical or electro-mechanical system has been proposed to meet this need. While the desirability has been recognized of providing a knitter that can be continuously and reliably operated at relatively high speeds of supply system component rotation that typically are in the range of about 600 to 1400 revolutions per minute with knitter needle stroke rates being maintained within the range of about 3000 to about 6000 per minute, a limiting factor that has stood squarely in the path of the provision of such a machine is the need for a strand supply, guide and feeding system that will function reliably, despite being subjected to significant centrifugal force and windage loadings, to effect controlled feeding, in unison, of a rotating array of strands of reinforcing material to the needles of a knitter head so that the needles can precisely and consistently implement a selected knit pattern as a web of reinforcing material is formed about a hose core that is traveling at relatively high speed through the workstation of the machine.

SUMMARY OF THE INVENTION

The present invention addresses the foregoing and other needs and drawbacks of the prior art by providing a novel and improved system for utilizing an array of positive feed devices that divide into a pair of force-isolated segments each of an array of feed paths along which strands of material such as yarn are fed while being payed out from supply packages for delivery to a workstation of a knitter, with the division into force-isolated segments of each of the separate feed paths serving to isolate erratic tensions that occur in strand reaches that are being payed out from supply packages from being transmitted to the reaches that feed the workstation, and with the operation of the positive feed devices being coordinated so that strand reaches that are received at the workstation exhibit a uniform feed rate that permits a highly uniform knit pattern to be formed about a hose core that is moving through the workstation, and that permits high speed knitting of the knit pattern to take place with a loadings that maximize the effective service life of the needles and such cam and guide components as cooperate with the needles to cause them to implement their knitting function.

Stated in another way, the system of the present invention addresses and overcomes a significant obstacle that has long stood in the path of development of a commercially acceptable high speed knitter of the type that can be used to provide a helical knit pattern in a web of knitted reinforcing material that is knitted about a hose core, namely the need for a strand feeding system that will permit knitting needle operation within the range of about 3000 to about 6000 strokes per minute while selected relatively movable components of the knitter head are being rotated at speeds that may be as high as about 600 to about 1400 revolutions per minute.

In preferred practice, each strand that is to be fed to a workstation of a high speed knitter follows a separate feed path which has a first reach that extends from a separate supply package to the capstan of a separate one of the positive drive units, a second reach that is wrapped around the capstan of its positive drive unit, and a third reach that extends from its positive drive unit to the knitter head. The capstans of the positive drive units are power driven, rotate in unison, and serve to tension the first reaches as is required to pay out the strands from their supply packages. Because the second reaches wrap tautly about the capstans of the positive drive units and rotate therewith at uniform speed, the third reaches are fed to the knitter head at a selected uniform feed rate and under substantially uniform tension regardless of such variations in tension as may be imparted to the first reaches as they are payed from their supply packages.

One feature of the preferred practice of the present invention is the use of a pair of positive feed belts, one of which serves to coordinate the driving of capstans that are provided by each of a plurality of positive drive units that are arranged in a generally circular array about a center axis of rotation, and the other of which transfers rotary drive motion from a stationary motor to the capstans to rotate the capstans at a speed that will feed strands of yarn to the needles of a knitter head at a feed rate that is selected to optimize the operation and longevity of service of the needles and their associated cam and guide components.

A further feature of the preferred practice of the present invention resides in the capability that it provides to operate the positive drive units to provide a strand feed rate to a rotating knitter head that is selected entirely independently from such rotational speed(s) as are selected for relatively movable components of the knitter head, and that is selected entirely independently from the cycle speed that is chosen for operating the knitter needles of the knitting head. Because yarn feed rate, knitter head rotation speed and the rate at which knitter needles execute their stroke-like motions all are selectable independently, the system of the present invention provides an extremely versatile knitter system that permits a variety of helical knit patterns to be formed about a hose core.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figures 1, 2:
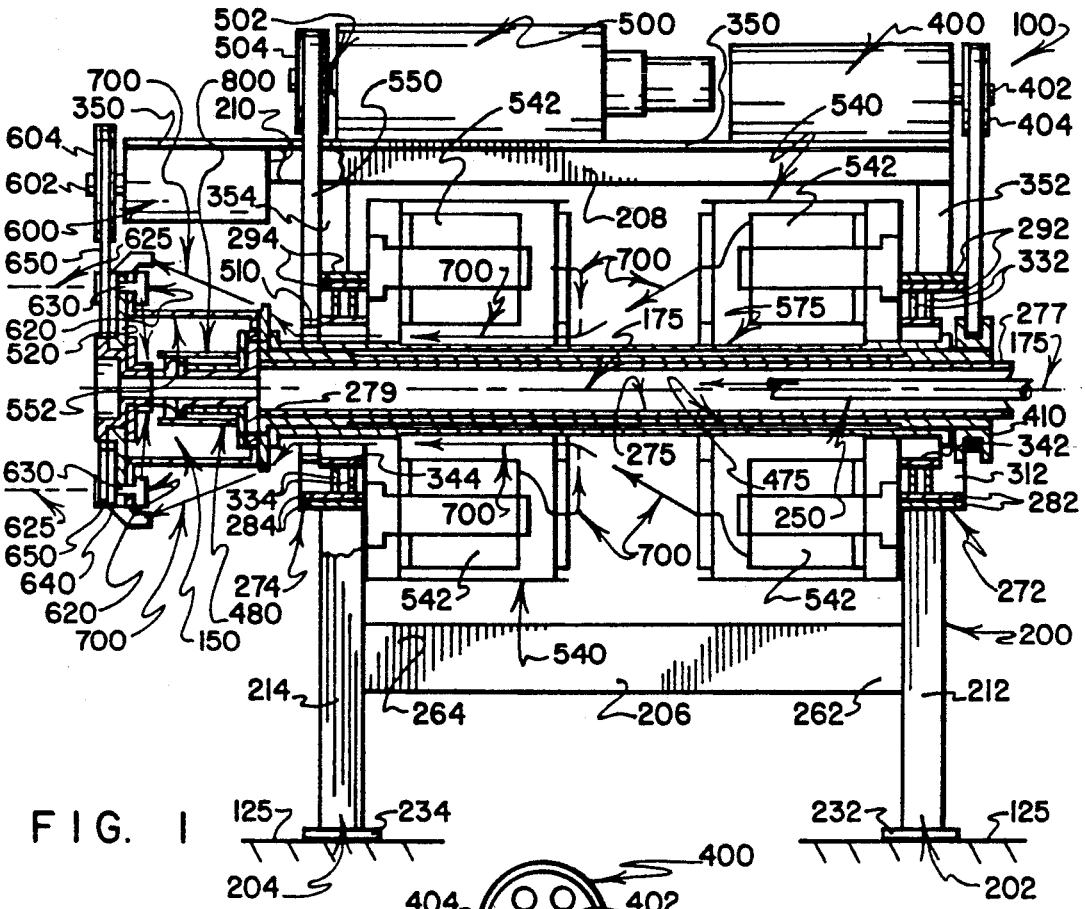
FIG. 1 is a front side elevational view of major components of a high speed knitter machine that embodies features of the preferred practice of the present invention for applying a knit web of strands of reinforcing material such as yarn about a hose core that is fed centrally through the knitter in a right-to-left "forward" direction of travel that extends generally along the depicted centerline, with portions of the knitter broken away and shown in cross section to permit otherwise hidden features to be seen, and with arrows indicating somewhat schematically some of the feed paths that are followed by individual strands of yarn as they are payed out from their supply packages.
FIG. 2 is a right end elevational view of selected portions of the knitter.
Figure 5:
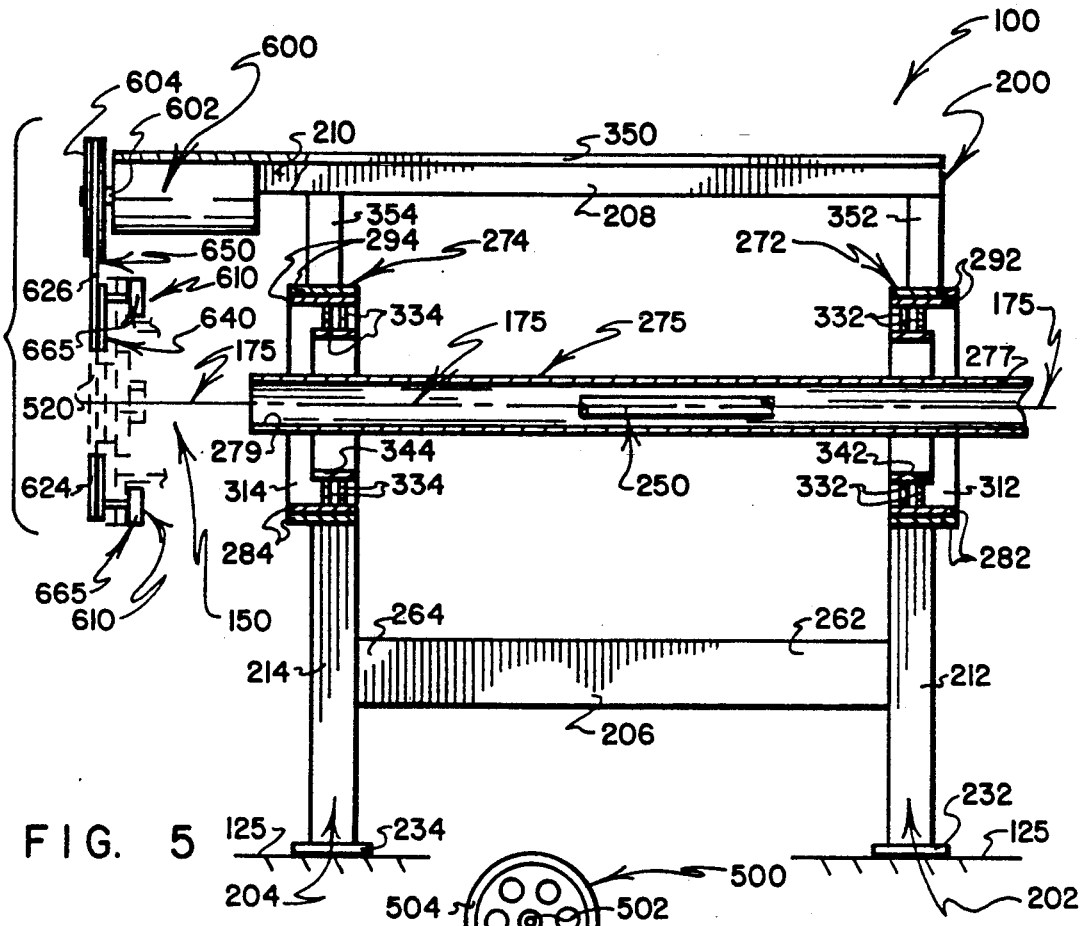
FIG. 5 is a side elevational view of selected portions of the knitter including an upstanding frame structure, a third drive motor, and selected components of the knitter that are rotated by the third drive motor.
Figure 6:
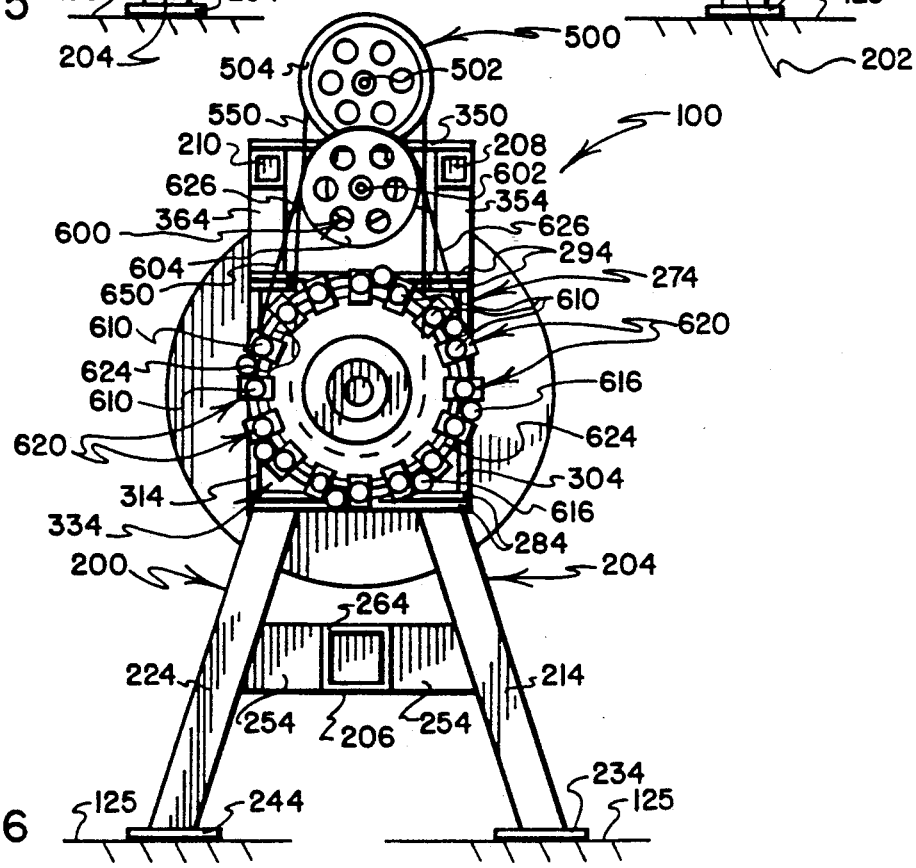
FIG. 6 is a left end elevational view of selected portions of the knitter.

Referring to FIGS. 1, 2 and 6, a high speed knitter machine that embodies the best mode known for carrying out the preferred practice of the invention that is described and claimed herein is indicated generally by the numeral 100. Because the invention relates to features of a system for feeding an array of strands of material such as yarn to a workstation 150 of the machine 100 (the workstation appears toward the left end of the machine 100 as shown in FIG. 1), and because features of the strand feeding system of the present invention can be used with a variety of other forms of knitter machines, only a selected number of the major components of the machine 100 are depicted in FIGS. 1-6. Other commonly employed components such as guards to protectively shroud moving parts and the like are well known and need not be described or illustrated herein to enable those who are skilled n the art to fully utilize the strand feeding system features that form the subject of the present invention.

The machine 100 has a welded upstanding support structure, major components of which are indicated generally by the numeral 200 in the front side view of FIG. 1, the right end view of FIG. 2, and the left end view of FIG. 6. The purpose of the support structure 200 is to provide a rigid framework for supporting other components of the machine 100 above a floor surface that is indicated generally by the numeral 125, with a substantial number of such components being arrayed about a center axis of the machine 100 which extends centrally through the workstation 150 and is indicated generally by the numeral 175 in FIGS. 1, 3-5 and 7.

The support structure 200 includes substantially identical, upstanding right and left frame assemblies 202, 204. A lower horizontally extending beam 206 underlies the center axis 175 and serves to rigidly interconnect lower portions of the frame assemblies 202, 204. A pair of front and rear upper horizontally extending beams 208, 210 serve both to connect upper portions of the frame assemblies 202, 204 and to extend leftwardly (as viewed in FIGS. 1 and 3-5) to provide support structure that overlies the region wherein the workstation 150 is located. Inasmuch as the character of the support structure 200 is of no particular import to the practice of the claimed invention and can be replaced by a wide variety of other forms of support structure, major features of the support structure 200 are described in general terms and are illustrated in the drawings with some simplification.

Referring to FIGS. 2 and 6, the right and left frame assemblies 202, 204 are of substantially identical character in that they have understructures formed by inwardly inclined legs 212, 222 and 214, 224, respectively. Feet 232, 242 and 234, 244 are provided at the lower ends of the legs 212, 222 and 214, 224, respectively. Right and left crossbars 252, 254 extend horizontally between the right and left legs 212, 222 and 214, 224, respectively. Right and left end regions 262, 264 of the lower beam 206 are connected to the right and left crossbars 252, 254, respectively.

Referring to FIGS. 1, 2 and 6, upper end regions of the right and left legs 212, 222 and 214, 224 connect with and support right and left box-shaped assemblies that are indicated generally by the numerals 272, 274. Referring principally to FIGS. 2 and 6, the box-shaped assemblies have lower and upper crossbar members 282, 284 and 292, 294 as well as front and rear upstanding members 302, 312 and 304, 314 that extend about peripheral portions of rectangular right and left mounting plates that are indicated generally by the numerals 332, 334. The right and left mounting plates 332, 334 extend in parallel planes that perpendicularly intersect the center axis 175. Relatively large diameter holes are formed centrally through the plates 332, 334 to receive and mount annular right and left support ring members 342, 344 such that the ring members 342, 344 extend concentrically about the center axis 175.

Referring still to FIGS. 1, 2 and 6, right and left uprights 352, 362 and 354, 364 extend vertically upwardly from the upper crossbar members 284, 286. Front uprights 352, 354 have their upper ends connected to the front horizontally extending beam 208. Rear uprights 362, 364 have their upper ends connected to the rear horizontally extending beam 210.

A motor mounting plate 350 is shown supported atop the horizontally extending beams 208, 210. Three independently functioning drive motors 400, 500, 600 are shown being supported by the mounting plate 350. The motor 400 is shown mounted atop the plate 350 near the right end of the frame structure 200, with a motor drive shaft 402 that extends rightwardly (as viewed in FIGS. 1 and 3) for supporting a drive pulley 404. The motor 500 is shown mounted atop the plate 350 near the left end of the frame structure 200, with a motor drive shaft 502 that extends leftwardly (as viewed in FIGS. 1 and 4) for supporting a drive pulley 504. The motor 600 is shown mounted on the underside of the plate 350 at a position that overlies the workstation 150, with a motor drive shaft 602 that extends leftwardly (as viewed in FIGS. 1 and 5) for supporting a drive pulley 604.

Referring principally to FIGS. 1 and 3-5 (and also to FIG. 7), a stationary tubular structure 275 extends concentrically about the center axis 175. The right end region of the stationary tubular structure 275 extends beyond the right end of the frame structure 200, as is indicated in FIGS. 1-5 by the numeral 277. The left end region of the stationary tubular structure 175 extends beyond the left end region of the frame structure 200, as is indicated in FIGS. 1, 3–5 and 7 by the numeral 279. To feed a hose core 250 (see FIGS. 1, 3–5 and 7) to the workstation 150, the hose core 250 is fed from right to left (as viewed in FIGS. 1, 3–5 machine 100) through the stationary tubular structure 275 along a path that, in essence, follows the center axis 175.

The motors 400, 500, 600 independently drive three sets of rotary components that are, in essence, supported by the aforedescribed frame structure 200 and/or by the stationary tubular member 275. Rotary components that are driven by the motor 400 are indicated in the drawings by reference numerals that are within the range of 401–499. Rotary components that are driven by the motor 500 are indicated by reference numerals that are within the range of 501–599. Rotary components that are driven by the motor 600 are indicated by reference numerals that are within the range of 601–699.

Among the rotary components that are driven by the motors 400 and 500 are a pair of tubular structures 475, 575 that extend concentrically about the center axis 175. The tubular structure 575 extends about the tubular structure 475; and, in turn, the tubular structure 475 extends about the stationary tubular structure 275. Because the tubular structures 275, 475, 575 have adjacent, concentrically extending portions that are spaced apart by relatively small distances, a view such as FIG. 1 (which depicts not only rotary components that are driven by various ones of the motors 400, 500, 600 but also stationary components) is somewhat difficult to follow if one wants to determine precisely which of the various rotary components are driven by various ones of the motors 400, 500, 600.

Figure 3:
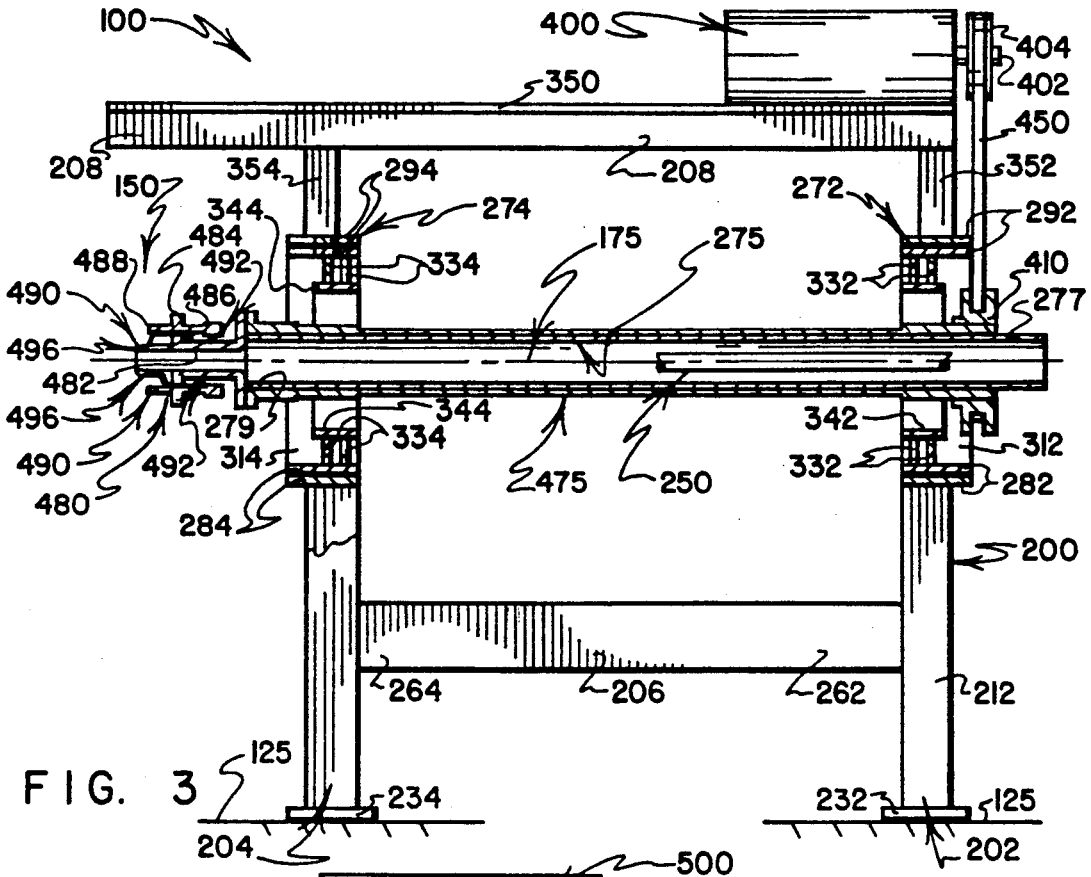
FIG. 3 is a side elevational view of selected portions of the knitter of FIG. 1 including an upstanding frame structure, a first drive motor, and selected components of the knitter that are rotated by the first drive motor.
Figure 4:
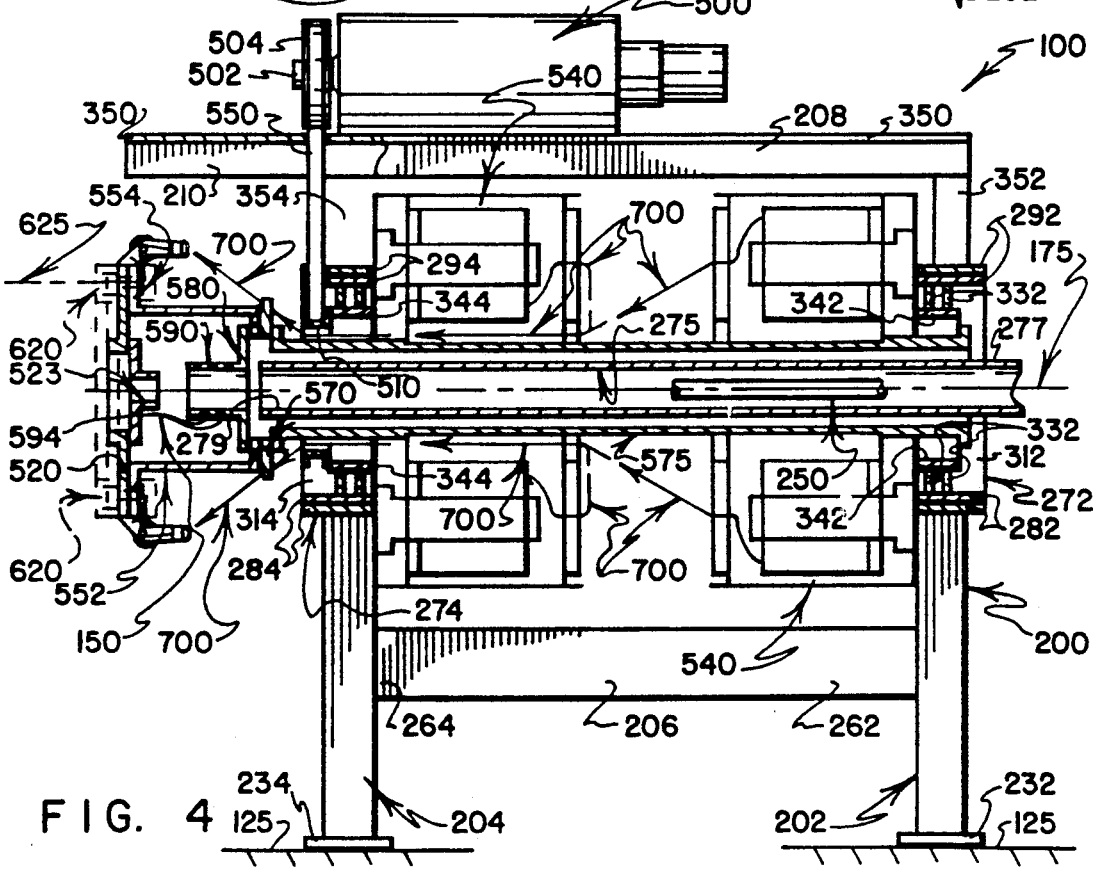
FIG. 4 is a side elevational view of selected portions of the knitter including an upstanding frame structure, a second drive motor, and selected components of the knitter that are rotated by the second drive motor, and with arrows indicating somewhat schematically some of the feed paths that are followed by individual strands of yarn as they are payed out from their supply packages.

Therefore, in an effort to promote a clear understanding of which components are driven by which motor, each of FIGS. 3, 4 and 5 presents a different set of the relatively rotatable components of the knitter 100. For example, in FIG. 3, depicted components include the frame structure 200 and the tubular structure 275, both of which remain stationary, and the drive motor 400 together with such rotary components as are driven by the motor 400. Similarly, in FIG. 4, depicted components include the frame structure 200 and the tubular structure 275, both of which remain stationary, and the drive motor 500 together with such rotary components as are driven by the motor 500. Likewise, in FIG. 5, depicted components include the frame structure 200 and the tubular structure 275, both of which remain stationary, and the drive motor 600 together with such rotary components as are driven by the motor 600.

In order for the tubular structures 475, 575 to be rotatable relative to each other and relative to the stationary tubular structure 275 and the stationary ring members 342, 344, suitable commercially available ball bearing assemblies (not shown) are interposed 1) between the stationary tubular structure 275 and its surrounding tubular structure 475 at locations near opposite ends thereof, 2) between the two rotatable tubular structures 475, 575 near opposite ends thereof, and 3) between opposite end regions of the tubular structure 575 and the ring members 342, 344. Inasmuch as the selection and placement of commercially available bearings to permit relative rotation of "tube-within-a-tube-within-a-tube" concentric arrangements of members such as the tubular structures 275, 475, 575 is well known to those who are skilled in the art, there is no need to dwell on this subject.

Figure 7:
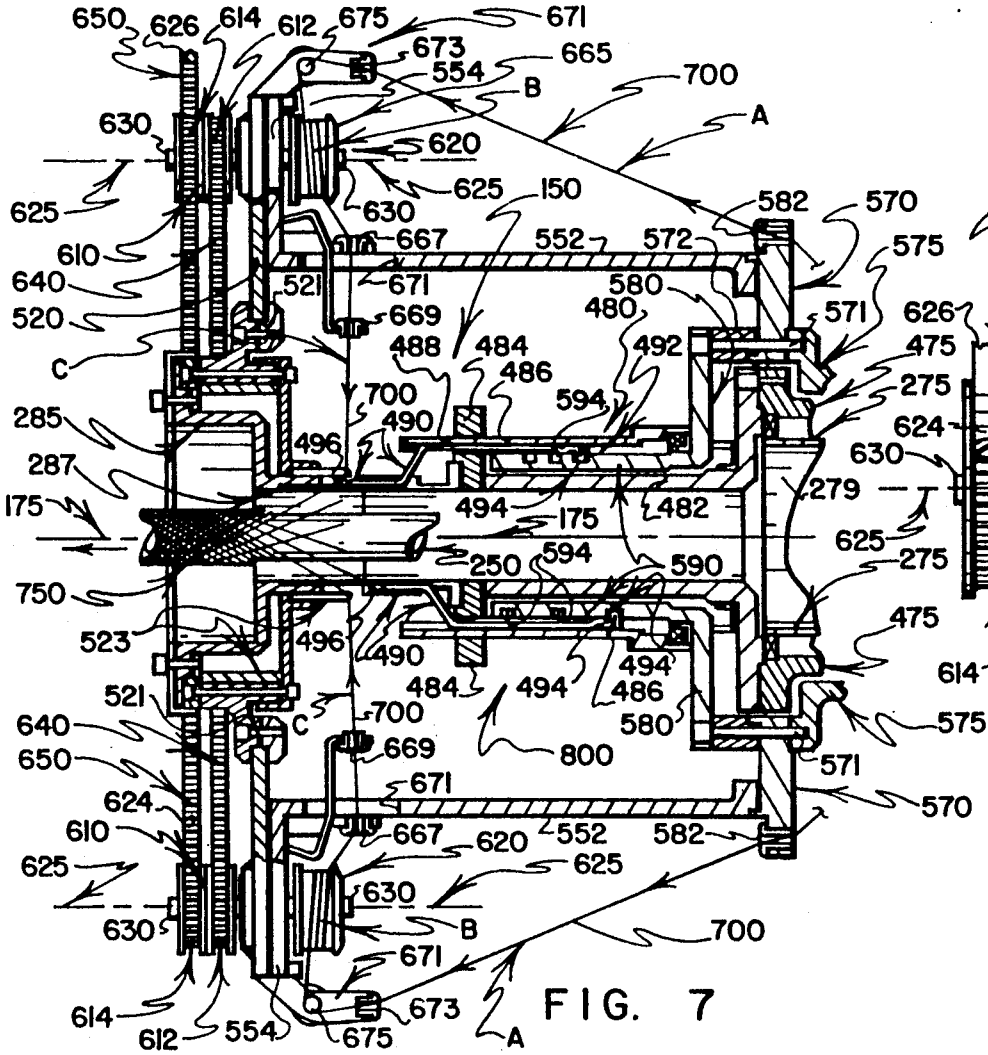
FIG. 7 is an enlarged side elevational view of left end portions of the knitter, with portions broken away and shown in cross section to permit otherwise hidden features to be seen, and with feed paths portions that are followed by some of the individual strands being indicated by solid lines.

What is significant, however, is that at a location toward the right side of the sets of relatively movable components that are depicted in FIG. 7, it will be seen that portions of the stationary tubular structure 275 are surrounded by portions of the relatively rotatable structure 475 which, in turn, are surrounded by portions of the relatively rotatable structure 575—whereby, the sets of relatively movable components that are depicted in FIG. 7 and that are connected to one or the other of the tubular structures 475, 575 (or that, together with the tubular structure 275, are held stationary) are caused to execute relative movements that are, in significant measure, controlled by the manner in which the tubular structures 475, 575 rotate relative to each other and relative to stationary components such as the tubular structure 275. However, before turning to a description of the sets of relatively movable components that are depicted in FIG. 7, the manner in which the drive motors 400, 500, 600 are linked to these various sets of the relatively movable components remains to be described.

Referring to FIGS. 1 and 3, a drive pulley 410 extends about and is drivingly connected to the right end region of the tubular structure 475. A drive belt 450 is reeved around the drive pulleys 404, 410 to drivingly connect the motor 400 to the tubular structure 475. By this arrangement, rotation of the drive shaft 402 by the motor 400 will cause corresponding rotation of the tubular structure 475 about the center axis 175—which explains a first of three ways in which input is provided to the sets of relatively movable components that are depicted in FIG. 7.

Referring to FIGS. 1 and 4, a drive pulley 510 extends about and is drivingly connected to the left end region of the tubular structure 575. A drive belt 550 is reeved around the drive pulleys 504, 510 to drivingly connect the motor 500 to the tubular structure 575. By this arrangement, rotation of the drive shaft 502 by the motor 500 will cause corresponding rotation of the tubular structure 575 about the center axis 175—which explains a second of three ways in which input is provided to the sets of relatively movable components that are depicted in FIG. 7.

Referring to FIGS. 1, 6, 7 and 9, a plurality of capstan assemblies 620 are arranged in a generally circular array that extends about the center axis 175, with each of the capstan assemblies 620 being connected to an annular plate 520. The plate 520 is designated by a "500 series" reference numeral because (as will be explained shortly) it is one of a number of components that are connected to the tubular member 575 for rotation therewith about the center axis 175. Because each of the capstan assemblies 620 has a bearing mounted shaft 630 that is rotatable about its own separate capstan rotation axis 625, it is possible for such components as are mounted on the capstan shafts 630 to be rotated together with their capstan shafts 630 about their respective capstan axes 625, with such rotation being effected independently of such rotation about the center axis 175 of the annular plate 520 as may take place as the result of the operation of the motor 500.

To provide input for rotating the capstan shafts 630 independently relative to the annular plate 520 on which the capstan assemblies 620 are mounted, dual-track positive drive pulleys 610 are mounted on and are drivingly connected to left end regions of the capstan shafts 630. A first one of the toothed "tracks" of each of the drive pulleys 610 is indicated by the numeral 612. A second one of the toothed "tracks" of each of the drive pulleys 610 is indicated by the numeral 614. First and second positive drive belts 640, 650 are provided for drivingly engaging the first and second toothed pulley tracks 612, 614, respectively.

Figure 9:
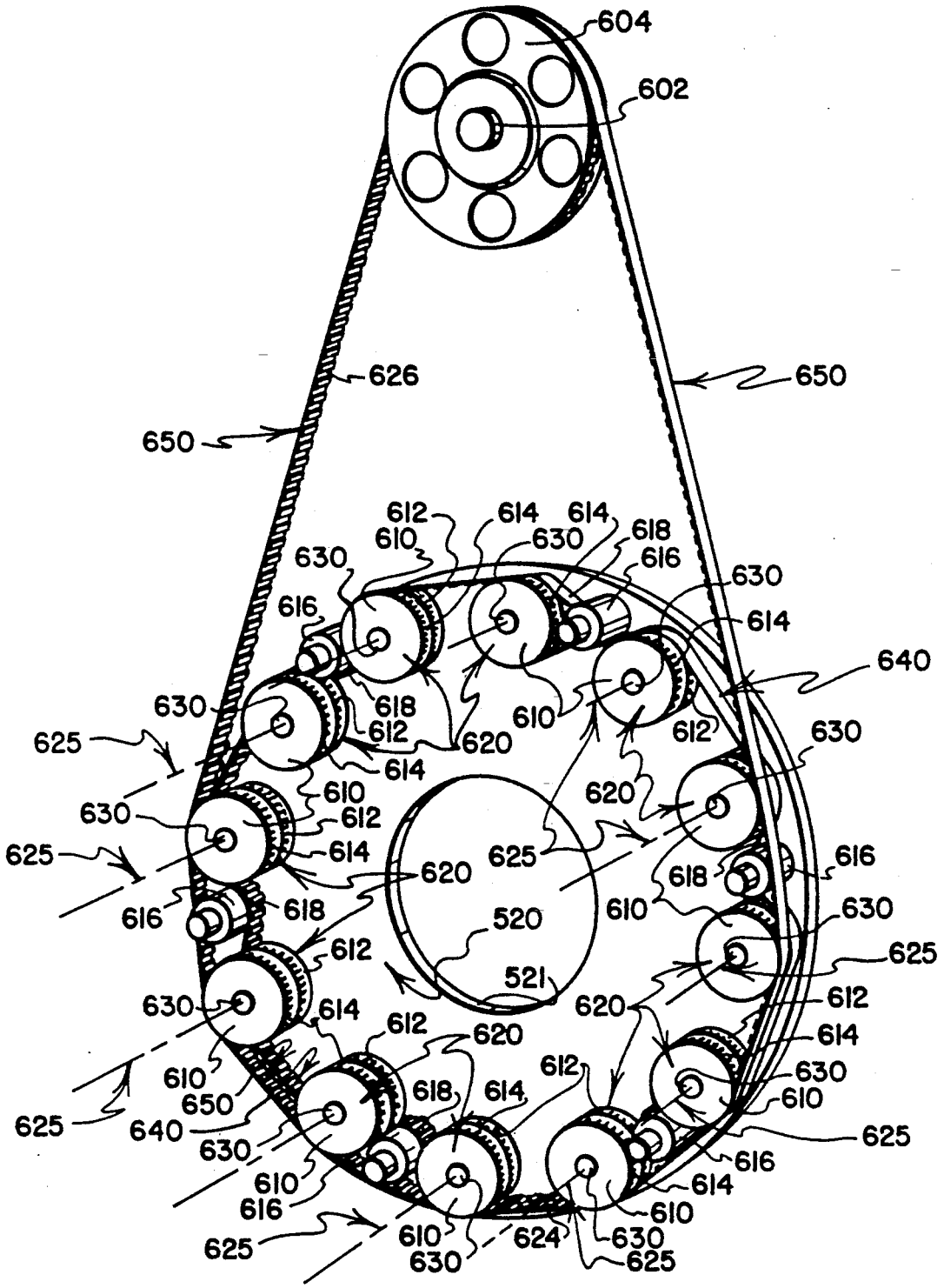

As is best seen in FIG. 9, the first positive drive belt 640 extends about the periphery of the array of pulleys 610 and is drivingly engaged by each of the toothed first tracks 612 to drivingly interconnect all of the pulleys 610 for concurrent rotation, in unison, about their respective capstan axes 625. Stated in another way, the first belt 640 performs a coordinating type of function in that it assures that if even one of the capstan shafts 630 is caused to rotate about its respective capstan axis 625, each of the other capstan shafts 630 will likewise be caused to rotate to an equal degree about its respective capstan axis 625. Idler pulleys 616 are interposed between adjacent alternate pairs of the pulleys 610 to draw radially inwardly reaches 618 of the belt 640 to assure that the belt 640 adequately engage the toothed first drive tracks 612 to assure that none of the pulleys 610 can slip relative to the belt 640, whereby coordinated concurrent rotation of the pulleys 610 is assured.

The second positive drive belt 650 has a lower reach 624 that extends about a lower portion of the periphery of the array of pulleys 610 so as to drivingly engage some but not all of the toothed second tracks 614 of the pulleys 610. An upper reach 626 of the belt 650 is reeved around a drive pulley 604 that is carried on the drive shaft 602 of the motor 600. By this arrangement, the second belt 650 performs the function of directly driving such ones of the pulleys 610 as it happens to engage at any one time, and relies on the coordinating function of the first belt 640 to assure that all of the pulleys 610 (and hence all of the capstan shafts 630) are rotated in unison relative to the annular plate 520 on which the capstan assemblies 620 are mounted.

If the annular plate 520 is rotated about the center axis 175 by the motor 500, this will cause successions of the second tracks 614 of the pulleys 610 to be brought into and withdrawn from drivingly engaging the second belt 650. However, regardless of which ones of the pulleys 610 are being directly engaged by the second belt 650, the coordinating function of the first belt 640 will assure that all of the pulleys 610 rotate about their respective capstan axes 625, in unison. Thus, the second positive drive belt 650 provides rotary motion to the array of pulleys 610 in response to operation of the motor 600, and the first positive drive belt 640 attends to rotating all of the pulleys 610 in unison—which explains a third of three ways in which input is provided to the sets of relatively movable components that are depicted in FIG. 7.

Because the several components that are depicted in FIG. 7 include not only components that remain stationary but also sets of components that move in various ways depending on the nature of their connections to one or more of the three "inputs" that are described above, the approach taken below to describe these various components in an orderly fashion begins with a description of the stationary components. Described next are the components that are connected to and rotate with the tubular member 475 in response to the operation of the motor 400. Described next are the components that are connected to and rotate with the tubular member 575 in response to the operation of the motor 500. Described last are the components that are driven by the motor 600.

Referring to FIG. 7, such components as are held stationary so as to not rotate or otherwise move relative to the frame structure 200 include the tubular member 275 (a left end portion of which is shown toward the right side of FIG. 7), and an annular guide assembly 285 (shown only in FIG. 7, toward the left side thereof) having a central opening 287 that extends concentrically about the center axis 175, through which opening the hose core 250 passes as strands 700 are being knitted therearound by an array of knitter needles 490 to form a knit web or jacket 750 about the hose core 250 at the workstation 150 of the machine 100. While no device is shown in FIG. 7 for holding stationary either the tubular member 275 or the annular guide assembly 285, suitable structure connected to the frame assembly 200 or extending upwardly from the floor 125 or the like can be provided in a wide variety of ways, as those who are skilled in the art will readily understand. While the annular guide assembly 285 can be held stationary, it also can be rotated, as may be desired, for example in coordination with rotation of such guide and supply structure as defines the feedpaths 700. Access to the tubular structure 275 for purposes of holding it stationary easily can be had at the right end of the machine 100 where the right end region 277 protrudes. Access to the annular guide assembly 285 for purposes of holding it stationary or for rotating it about the center axis 175 is readily attainable at the left end of the machine 100.

Referring to FIGS. 3 and 7, components that rotate with the tubular structure 475 include an annular needle guide assembly 480 that carries the knitter needles 490. The guide assembly 480 has a generally cylindrical inner portion 482 from which projects a radially outwardly extending annular flange 484. Extending axially rightwardly and leftwardly from the vicinity of the flange 484 are right and left sleeve portions 486, 488. The rightwardly extending sleeve portion 486 concentrically surrounds the cylindrical portion 484 but at a distance spaced radially outwardly therefrom, whereby an annular space 492 is defined between the sleeve portion 486 and the cylindrical inner portion 482.

It is within the annular space 492 that a tubular cam carrying portion 590 (see FIGS. 4 and 7) of a cam member 580 connects with right end regions 494 of the knitter needles 490 to cause the knitter needles 490 to execute back and forth stroke movements that extend in directions paralleling the center axis 175. The right end regions 494 of the needles 490 are turned radially inwardly so as to extend toward the cylindrical portion 484 (for being received with cam grooves 594 that are formed in the cam member 580—as will be discussed in greater detail in conjunction with the description of components that are connected to and rotate with the tubular structure 575). Left end regions 496 of the knitter needles 490 define suitably configured strand-engaging formations that function in the customary way to effect relative movements of various ones of the strands 700 in order to knit a jacket or web 750 of strand material 700 about a hose core 250 that is passing through the workstation 150 in a right to left direction.

Referring to FIGS. 4 and 7, a relatively large number of components are connected to and rotate with the tubular structure 575. For the present, however, attention is directed to the right side of FIG. 7 wherein an annular guide-carrying member 570 is connected by threaded fasteners 571 to an annular spacer sleeve 572 and to the annular flange 582 of the cam member 580. Strand guide eyelets 582 are carried by the guide-carrying member 570, with a separate guide eyelet 582 being provided for receiving and guiding each of the strands 700.

A tubular cam-groove-carrying portion 590 of the cam member 580 extends leftwardly from its juncture with the mounting flange 582 and extends into the annular space 492. Circumferentially extending grooves 594 are formed about the circumference of the tubular portion 590 for receiving the inwardly turned right end regions 494 of the knitter needles 490. The grooves 594 have something of a generally sinusoidal shape as they extend circumferentially about the tubular portion 590. By this arrangement, any relative rotation whatsoever that takes place between the tubular structures 475, 575 will cause the knitter needles 490 to effect at least some "stroking" movement in directions that extend parallel to the center axis 175.

In operation, the motors 400, 500 are set to effect the kind of relative rotation that needs to take place between the tubular structures 475, 575 (and hence between the needle guide assembly 480 and the cam member 580) to cause the stroking of the knitter needles 490 to engage and move the strands 700 that are fed to the workstation 150 to implement a desired configuration of knit pattern in the jacket or web 750 of reinforcing material that is being formed about the hose core 250 as it moves continuously from right to left along the center axis 175 through the workstation 150 of the knitter 100.

Taken together, the needle guide assembly 480, the needles 490 and the cam member 580 comprise what is referred to by the term "knitter head"—an assemblage of components that embodies features that are well known to those who are skilled in the art, and which is designated in FIG. 7 by the numeral 800. Because any of a variety of well known forms of knitter heads can be used that have needle operating grooves 594 that are configured as may be desired to effect various types of relative needle movements as the tubular structures 475, 575 are rotated relative to each other, and because the exact character of the chosen knitter head 800 that is used with the machine 100 is not of import as regards the novel and improved system of the present invention that is used to feed strands 700 to the workstation 150, there is no need to dwell further on the character of any one knitter head 800 that one might select to use with the machine 100 by positioning it at the workstation 150 and connecting its relatively rotatable needle guide and cam components to the relatively rotatable tubular structures 475, 575, respectively.

As those who are skilled in the art will readily understand, by modifying the manner in which the needle guide assembly 480 and the cam member 580 rotate relative to each other, the resulting helix angles of the "wales" and the "courses" of strand material 700 that are applied to form the knit jacket or web 750 can be controlled to provide a desired type of helix-wound knitted reinforcement layer 750. However, inasmuch as features of the present invention relate to the feeding of strands 700 to the workstation 150 and do not concern themselves with the configuration of the knit pattern that is formed in the reinforcement layer 750, it will be understood that the knit pattern that is depicted somewhat schematically in FIG. 7 is not intended to indicate or exemplify any particular type of knit pattern that one may select to form as by making use of the versatile capabilities of the machine 100 through the selection of various relative speeds of operation of the motors 400, 500, 600.

Referring to FIGS. 1 and 4, among other components that are connected to the tubular structure 575 for rotation therewith are two rotary banks 540 of supply packages 542 of the strand material 700, typically yarn. The supply package form that is illustrated are spools that contain the strand material 700 that is to be used in knitting the jacket or web 750 of reinforcing material. Each of the banks 540 typically holds six of the spool-type supply packages 542, with the packages 542 being arranged in a circular array of opposed pairs of packages that are positioned symmetrically about the center axis 175 in precisely the manner that opposed pairs of supply packages 542 are shown positioned in FIGS. 1 and 4.

In operation, the banks 540 of supply packages 542 rotate about the center axis 175 together with the rotation of their supporting tubular structure 575 in response to operation of the motor 500. Strands 700 are payed out from the supply packages 542 and are fed along separate feed paths (indicated somewhat schematically in FIGS. 1 and 4 by strand direction arrows 700) for eventual delivery to the workstation 150. As is customary, at relatively frequent intervals along each of the strand feed paths, suitable strand guides are provided that are designed to be as "easy to thread" as possible so that, if one or more of the strands 700 breaks, or if the supply packages 542 become depleted, only a relatively brief amount of machine "down time" will be needed to effect needed rethreading. While no strand guides are depicted in FIGS. 1 and 4, a number of typical strand guides are illustrated in FIGS. 7 and 8, for example the strand guide eyelets 582 that are carried by the annular guide-carrying member 570.

Referring to FIGS. 4 and 7, extending leftwardly from the annular guide-carrying member 570 is a generally cylindrical drum 552 that is rigidly connected to the member 570 by threaded fasteners (not shown). At the left end of the drum 552, a radially outwardly projecting annular mounting flange 554 is provided for engaging and supporting the annular plate 520. Referring to FIG. 8 wherein a typical one of the capstan assemblies 620 is depicted, it will be seen that the capstan shaft 630 is provided with a spaced pair of ball bearings 663 that journal the capstan shaft 630 for rotation relative to the assembly that is formed by the annular mounting flange 554 and the annular plate 520. One of the dual-track drive pulleys 610 is drivingly connected to the left end region of the capstan shaft 630. A strand-receiving spool 665 is drivingly connected to the right end region of the capstan shaft 630—whereby the spool 665 is drivingly connected to the dual-track drive pulley 610 for concurrent rotation therewith.

Figure 8:
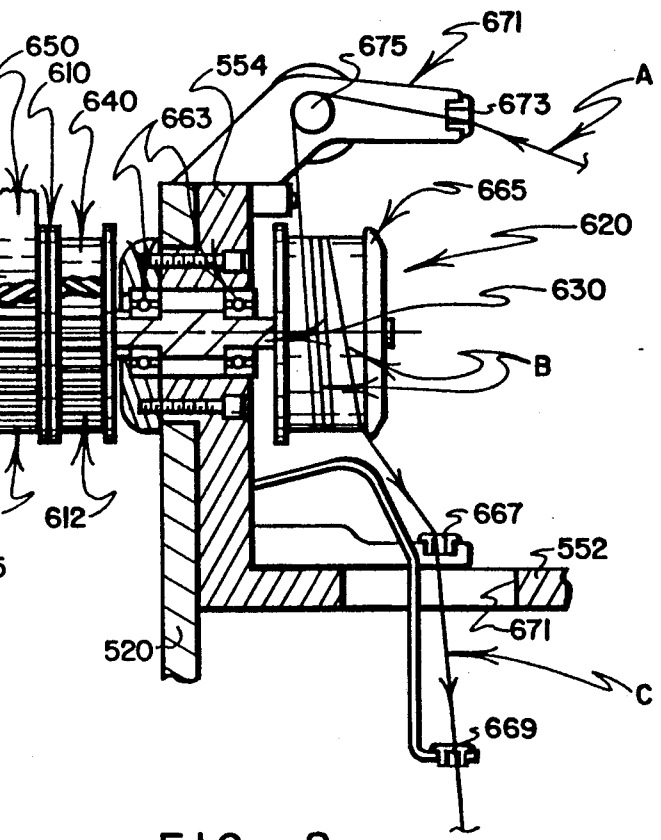
FIG. 8 is an enlarged side elevational view of selected components that appear in the left upper corner region of view of FIG. 7, with portions broken away and shown in cross section to permit otherwise hidden features to be seen, and with portions of a feed path that is followed by one of the individual strands as it engages a capstan assembly on its way toward being fed to a workstation of the knitter being indicated by solid lines; and, FIG. 9 is a perspective view, on an enlarged scale, showing features of a belt drive system used to rotate and to coordinate the rotation of a plurality of capstan assemblies of the type shown in FIG. 8.

Referring to FIGS. 7 and 8, each of the spools 665 are provided with a separate guide assembly 671 that carries guides 673, 675 for receiving portions of the strand 700 that initially are fed to the guide assembly 671 from the eyelet guides 582. Each of the guide assemblies 671 feeds a separate one of the strands 700 to a separate one of the capstan spools 665 of a separate one of the capstan assemblies 620. Each strand 700 is wrapped a plurality of times around its associated capstan spool 665. Upon exiting its associated capstan spool 665, each of the strands 700 is fed through a pair of guide eyelets 667, 669 that are located on opposite sides of an associated opening 671 that is formed through the drum 552, whereupon the strand 700 moves radially inwardly to the workstation 150 for being engaged by the needles 490 of the knitter head 800 to form the knitted jacket or web 750 of reinforcing material that is put in place about the traveling hose core 150.

Referring to FIGS. 7 and 8, the capstan assemblies 620 comprise what can be referred to as a set of "positive drive units" that rotate, with precision and in unison, to concurrently feed each of the strands 700 along its associated feed path from its associated supply package 542 to the workstation 150. While the coordinated operation of the "positive drive units" 620 is one key to the uniform type of feeding of strands that is provided to the workstation 150, an equally important function that is performed by the "positive drive units" 620 is to "tension isolate" the strand reaches that extend from the capstan spools 665 to the workstation 150 from the strand reaches that extend from the supply packages 542 to the capstan spools 665.

Stated in another way, each of the strands 700 can be thought of as having three distinct "reaches" or feed-path segments along which it is fed. Referring exclusively to FIGS. 7 and 8, a "first reach" "A" of each of the two depicted strands 700 extends from the strand's associated supply package 542 to its associated capstan spool 665—a strand reach that is subjected to widely varying tension inasmuch as the force that the capstan spool 665 must exert to pay out a strand from its supply package 542 often varies quite substantially from moment to moment. A "second reach" "B" is formed by the portion of the strand that is tautly wrapped around its associated capstan spool 665. A "third reach" "C" is the portion of the strand 700 that extends from the capstan spool 665 to the workstation 150 (i.e., to the knitter head 800 for being engaged and gently tensioned by an associated knitter needle 490 as the jacket or web of reinforcing material 750 is knitted).

Because the "second reach" "B" is tautly wrapped about an associated one of the spools 665 of one of the "positive drive units" 620 so as to be fed uniformly at all times to the workstation 150, the variations in tension that are experienced in the "first reach" "A" are entirely isolated from being transmitted through the "second reach" "B" to the "third reach" "C"—whereby such tension as is maintained in the "third reaches" "C" of the strands 700 is controlled by the operation of the knitter needles 490 and by the speed of rotation of the "positive drive units" 620. By this arrangement, strand material 700 is fed to the knitter needles 490 quite evenly and at a relatively low, controlled level of tension that can be optimized to maximize the service life of the needles 490 and the associated cam and guide components that control the stroke-type movements that the needles 490 execute to carry out a their knitting function.

Referring to FIG. 9, a center opening 521 is formed through the annular plate 520. Referring to FIG. 7, it will be seen that an assembly which is indicated generally by the numeral 523 is mounted within the opening 521. Components of the assembly 523 extend into the region of the operation of the knitter needles 490 and cooperate therewith to aid in guiding the operation of the needles 490 and the strands 700 while a knitting operation is performed by the needles 490.

As will apparent from the foregoing description, the strand feeding system of the present invention provides a set of "positive drive units" 620 that each engage a separate one of an array of strands 700 that are to be fed from separate sources of supply 542 to a workstation 150. The "positive drive units" 620 serve not only to effect the feeding of strands 700 to the workstation 150 concurrently and exactly in unison at identical feed rates, but also to "tension isolate" the reaches "C" of the strands 700 that are fed to the workstation 150 from significant fluctuations in strand tension that are incurred in the reaches "A" as strand material is payed out from the supply packages 542. This arrangement permits strand material such as yarn to be payed out from the supply packages 542 in the presence of high centrifugal force and windage loadings such as are encountered if the machine 100 is operated at a strand package rotation speed of between about 600 to about 1400 revolutions per minute.

Still another important advantage that results from the "uniform feeding" of strand material at "evenly controlled tension" to the knitter needles 490 is that the speed of operation of the knitter needles 490 can be dramatically increased to operate at relatively high stroke rates that typically are within the range of about 3000 to about 6000 strokes per minute—which is desired if the machine 100 is to be highly productive in continuously delivering reinforced hose.

Still another significant advantage that results from the "uniform feeding" of strand material at "evenly controlled tension" to the knitter needles is that the resulting product (e.g., a hose core that has a knitted jacket or web of reinforcing material tautly surrounding its outer surface, is characterized by a substantially flawlessly placed knit pattern that is formed of strands of reinforcing material that are substantially uniformly tensioned) should represent an genuinely improved product as compared to a substantially similar product (i.e., a product that has the same knit pattern but which has not had its strands "uniformly fed" under "evenly controlled tension" to the workstation where it was knitted). Thus, even if the human eye cannot detect a difference in the appearance of products that are formed with and without the use of features of the present invention, it is nonetheless appropriate to include in the claims that follow "product by process" claims that relate to what reasonably ought to be perceived as being constituting an improved product that results from the practice of the system of the present invention.

By using three separately controllable drive motors 400, 500, 600 to selectively power the operation of the aforedescribed sets of relatively movable components, a highly versatile type of machine 100 is provided that is capable of functioning at high rates of productivity with minimal machine "down time" being required to replace broken, damaged or worn components such as the needles 490. Furthermore, a variety of types of knit patterns can be produced in the jacket or web 750 of reinforcing material that is formed about the hose core 150, with these variations being controlled principally by suitably setting the relative speeds of operation of the motors 400, 500, 600.

Although the aforedescribed structure and certain of its components parts are depicted in the drawings as extending substantially vertically, substantially horizontally or in some other orientation, it should be kept in mind that a feature of the system of the present invention resides in the fact that it can be used with arrays of strand feed paths that extend in substantially any conceivable orientation. Thus, while such terms as "horizontally extending," "vertically extending," "left," "right" and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. A method of uniformly, evenly and concurrently feeding a plurality of strands of material such as yarn along an array of feedpaths to a workstation of a knitter machine while the array of feedpaths rotates about an imaginary center axis that extends through the workstation, comprising the steps of:

a) providing feedpath defining means including structure for extending about and for being rotated about an imaginary center axis that extends through a workstation of a knitter machine and for defining an array of feedpaths that extends about the center axis for directing a plurality of strands of material such as yarn to the workstation, with each of the strands being directed along a separate one of the feedpaths;

b) providing rotatable capstan means including a plurality of capstans that are connected to said structure for being rotated together with said structure about the center axis, and for being rotated relative to said structure about a plurality of spaced capstan axes that are arranged in an array that extends about the center axis, with each of the capstans being rotatable about a separate one of the capstan axes, and with each of the capstans being associated with a separate one of the feedpaths by being positioned therealong and by being adapted to drivingly engage a taut wrapping of a separate one of the strands as such strand moves along the associated feedpath to the workstation;

c) providing first rotary drive means for rotating said structure together with said capstans about the center axis;

d) providing second rotary drive means for rotating said capstans concurrently and in unison about the respective capstan axes relative to said structure to effect positive concurrent feeding, in unison, of each of a plurality of strands along said array of feedpaths to the workstation;

e) operating the first rotary drive means to rotate said structure together with said capstans about the center axis, whereby said array of feedpaths is caused to rotate about the center axis; and, f) operating the second rotary drive means concurrently with the operation of the first rotary drive means to rotate said capstans concurrently and in unison to effect feeding of a plurality of strands of material such as yarn along the rotating array of feedpaths, with each of the strands extending along a separate associated one of the feedpaths and having a wrapping that extends tautly about a separate associated one of the capstans so that the feeding of each strand is effected by transmitting rotary movement of the associated capstan to the associated strand wrapping that extends tautly about the associated capstan, whereby the plurality of strands are fed uniformly, evenly and concurrently to the workstation.

2. A method of paying out from a plurality of supply packages a plurality of strands of material such as yarn, of feeding the plurality of strands along an array of feedpaths to a workstation of a knitter machine, and of tension-isolating such reaches of the strands as are fed to the workstation from such tension force variations as are incurred by other reaches of the strands as they are payed out from the supply packages, with the paying out of the strands, the feeding of the strands and the isolating of strand tension forces being effected while the array of feedpaths is rotated about an imaginary center axis that extends through the workstation, comprising the steps of:

a) providing feedpath defining means including structure for extending about and for being rotated about an imaginary center axis that extends through a workstation of a knitter machine and for defining an array of feedpaths that extends about the center axis for directing a plurality of strands of material such as yarn to a workstation as the strands are payed out from a plurality of supply packages that are connected to said structure for rotation therewith about the center axis, with each of the strands being directed along a separate one of the feedpaths that each emanate from a separate associated one of the supply packages and terminate at the workstation;

b) providing rotatable capstan means including a plurality of capstans that are connected to said structure for being rotated together with said structure about the center axis, and for being rotated relative to said structure about a plurality of spaced capstan axes that are arranged in an array that extends about the center axis, with each of the capstans being rotatable about a separate one of the capstan axes, and with each of the capstans being associated with a separate one of the feedpaths by being positioned therealong and by being adapted to drivingly engage a taut, plural-turn wrapping of a separate one of the strands as such strand moves along the associated feedpath to the workstation;

c) providing first rotary drive means for rotating said structure together with said capstans about the center axis;

d) providing second rotary drive means for rotating said capstans concurrently and in unison about the respective capstan axes relative to said structure to effect positive concurrent feeding, in unison, of each of a plurality of strands along said array of feedpaths to the workstation;

e) operating the first rotary drive means to rotate said structure together with said capstans about the center axis, whereby said array of feedpaths is caused to rotate about the center axis; and, f) operating the second rotary drive means concurrently with the operation of the first rotary drive means to rotate said capstans concurrently and in unison to effect feeding of a plurality of strands of material such as yarn along the rotating array of feedpaths, with each of the strands extending along a separate associated one of the feedpaths and having a plural-turn wrapping that extends tautly about a separate associated one of the capstans so that the feeding of each strand is effected by transmitting rotary movement of the associated capstan to the associated plural-turn strand wrapping that extends tautly about the associated capstan, whereby the action of the second rotary drive means in effecting concurrent rotation of the capstans to effect positive feeding of the strands along the feedpaths taken together with the taut, plural-turn wrappings of the strands about the capstans serve to tension-isolate such reaches of the strands as extend from the capstans to the workstation from tension force variations that are incurred in strand reaches which extend from the supply packages to the capstans, with the result that strand material is fed to the workstation uniformly, evenly, concurrently and without being subjected to said tension force variations.

3. The method of claim 1 wherein:

a) the step of providing rotary drive means includes the steps of providing first drive interconnection means for drivingly interconnecting all of the capstans for concurrent rotation about the associated capstan axes, and providing second drive interconnection means for drivingly connecting a selected number of the capstans to said second rotary drive means; and, b) the step of operating said second rotary drive means includes the steps of delivering rotary motion from said second rotary drive means through said second drive interconnection means to said selected number of capstans, and delivering rotary motion from said selected number of capstans through said first drive interconnection means to all of the other capstans to that the capstans all are rotated concurrently and in unison about the associated capstan axes to effect feeding of the plurality of strands uniformly, evenly and concurrently to the workstation.

4. The method of claim 3 wherein:

a) the step of providing feedpath defining means includes the step of providing said structure in a form that extends substantially concentrically about the workstation, and that carries bearing means including a plurality of bearings that are connected to said structure at spaced locations where the spaced capstan axes intersect with said structure, with each of the capstan axes having at least one bearing associated therewith at the location where the capstan axis intersects with said structure;

b) the step of providing rotatable capstan means includes the step of providing each of said capstans with a capstan shaft that extends along the associated capstan axis for being received by an associated bearing that is carried by said structure so as to be journalled for rotation about the associated capstan axis relative to said structure;

c) the step of providing rotatable capstan means additionally includes the step of providing said capstans with spool-shaped means including a plurality of spools for defining generally cylindrical outer surfaces, with each of the spools being associated with a separate one of the capstans by being drivingly connected to the associated capstan shaft and by positioning the generally cylindrical outer surface to extend concentrically about the associated capstan axis along the associated feedpath of receiving said wrapping of strand material thereabout;

d) the step of providing first rotary drive means includes the step of providing first drive pulley means including a plurality of first drive pulleys that each are drivingly connected to a separate one of the capstan shafts for rotation therewith;

e) the step of providing the first drive interconnection means includes the step of providing first flexible endless drive means for engaging and drivingly interconnecting all of the first drive pulleys for concurrent rotation about the associated capstan axes; and, f) the step of operating the second rotary drive means includes the step of transmitting rotary motion from the first drive pulleys of said selected number of capstans through the first flexible endless drive means to the first drive pulleys of all of the other capstans so that the spools of all of the capstans are rotated concurrently and in unison about the associated capstan axes to effect feeding of the plurality of strands uniformly, evenly and concurrently to the workstation.

5. The method of claim 4 wherein:

a) the step of providing first rotary drive means includes the step of providing second drive pulley means including a plurality of second drive pulleys that each are drivingly connected to a separate one of the capstan shafts for rotation therewith;

b) the step of providing the second drive interconnection means includes the step of providing second flexible endless drive means for engaging and drivingly interconnecting with the second drive pulleys of said selected number of capstans and with said second rotary drive means; and, c) the step of operating the second rotary drive means includes the step of transmitting rotary motion from the second rotary drive means to the second drive pulleys of said selected number of capstans.

6. The method of claim 1 additionally including the step of operating knitter needles at the workstation of the knitter machine to form a knitted jacket of material about a product core that is fed substantially continuously to and through the location of the workstation.

7. The method of claim 6 wherein the knitter needles are cycled back and forth in stroking movements at the workstation, with the rate at which such stroking movements are carried out being within the range of about 3000 to about 6000 cycles per minute.

8. The method of claim 6 or 7 wherein the feedpath defining means is rotated about the center axis at a speed of rotation that is within the range of about 600 to about 1400 revolutions per minute.

9. The method of claim 5, 6 or 7 wherein the product core that is fed substantially continuously to and through the location of the workstation is a core of a flexible hose, wherein the knitted jacket of material that is knitted at the workstation is applied tautly to the outer surface of the core of flexible hose to form a reinforcing jacket of material extending thereabout, whereby the core of flexible hose emerges from the workstation bearing a tautly knitted jacket of reinforcing material.

10. A method of ensuring that all of a set of strands that are fed along a rotating array of separate feedpaths for delivery to a workstation are delivered to the workstation uniformly, evenly and concurrently, and of ensuring that reaches of each of the strands that are fed to the workstation are isolated from such erratic tension forces as tend to be incurred by strands as they are payed out from supply packages, comprising the steps of:

a) providing an array of substantially identical rotatable capstans that receive first reaches of strands that have been payed out from supply packages, and that deliver second reaches of such strands to a workstation;

b) rotating the array of capstans in unison with the rotation of the array of feedpaths, with each of the capstans being positioned along a separate associated one of the feedpaths for receiving a plural-turn wrapping of associated strand material that is to be fed along the associated feedpath from the first reach to the second reach; and, c) rotating the rotatable capstans uniformly, evenly and concurrently to effect uniform, even and concurrent feeding of the set of strands to the workstation, with the taut plural-turn wrapping of the strands about associated capstans serving to isolate the second reach of each of the strands from such variations in tension force as tend to be incurred by the first reach of each strand as the strand is payed out from a supply package.

11. The method of claim 10 wherein the step of rotating the array of capstans includes the step of rotating the array of capstans about a center axis that extends substantially centrally through the workstation, and the step of providing the array of capstans includes the step of positioning the capstans at substantially equal distances from the center axis in an array that extends about the workstation so that each of the set of strands has a reach of substantially equal length that extends from the associated capstan to the workstation.

12. The method of claim 11 wherein the step of rotating the array of capstans additionally includes the step of rotating each of the capstans about a separate capstan axis that extends substantially parallel to the center axis.

13. The method of claim 12 wherein the step of rotating the array of capstans additionally includes the step of drivingly interconnecting the capstans for concurrent rotation about the respective capstan axes so that, if one of the capstans is rotated about the capstan axis, all of the other capstans will be caused to rotate in unison therewith about the respective capstan axes.

14. The method of claim 12 wherein the step of rotating the array of capstans additionally includes the steps of drivingly connecting some but not all of the capstans to a source of rotary motion to effect rotation in unison of such ones of the capstans as are drivingly connected to the source of rotary motion, and providing a separate driving connection among all of the capstans to ensure that when less than all of the capstans are directly driven by the source of rotary motion, all of the capstans will, nonetheless, be driven so as to rotate in unison.

15. A method of selectively controlling the character of a spiral knit pattern that is formed about a core of hose material that is fed continuously through the workstation of a knitter machine, comprising the steps of:

a) providing a first and second relatively rotatable tubular structures that extend coaxially about a center axis with the first extending principally within the interior of the second, and with the second extending principally about the exterior of the first;

b) providing a first variable speed drive motor that is drivingly connected to the first tubular structure for rotating the first tubular structure about the center axis at a first independently selected speed of rotation;

c) providing a second variable speed drive motor that is drivingly connected to the second tubular structure for rotating the second tubular structure about the center axis at a second independently selected speed of rotation;

d) providing a knitter head having first and second relatively rotatable components that cooperate to support and movably mount a set of knitter needles that are adapted to engage and knit a plurality of strands that are delivered to a workstation of a knitter machine to form a spiral knit pattern about a core of hose material that is fed continuously through the workstation, with the first relatively rotatable component being drivingly connected to and supported by the first tubular structure, and with the second relatively rotatable component being drivingly connected to and supported by the second tubular structure;

e) providing at least one bank of supply packages from which strands can be payed out, with the bank of supply packages being connected to and supported by the second tubular structure for rotating therewith about the center axis;

f) providing strand feeding apparatus including rotary structure that extends in substantially in surrounding relationship about the workstation for receiving strands that pay out from the bank of strand supply packages and for feeding a rotating array of such strands uniformly, evenly and concurrently to a knitter machine workstation while the first and second tubular structures are being rotated by the first and second variable speed motors, respectively, with the strand feeding apparatus being connected to and supported by the second tubular structure for rotation therewith about the center axis, with the strand feeding apparatus defining at least portions of an array of separate feedpaths along which strands that are payed out from the bank of strand supply packages are to be fed in traveling from the bank of strand supply packages to the workstation;

g) providing positive drive means for feeding strands along said feedpath portions including a plurality of positive drive units that are connected to said rotary structure for rotation therewith about the center axis, with each of the positive drive units being located along a separate one of the strand feedpath portions, with each of the positive drive units including a capstan that is rotatatable relative to said rotary structure about a separate capstan axis, and with each of the capstans defining a generally cylindrical strand receiving formation that is associated with a separate one of the strand feedpath portions by being positioned therealong and by receiving a taut wrapping of a strand that is fed therealong;

h) providing a third variable speed drive motor that is drivingly connected to the capstans for rotating the capstans about the respective capstan axes, in unison, to effect uniform, even and concurrent feeding of strand reaches that extend from each of the capstans to the workstation by driving all of the capstans in unison and without slippage of the strand wrappings about the associated the strand receiving formations of the capstans; and, i) continuously feeding a core of hose material to and through the workstation while concurrently controlling the speed of operation of the first, second and third variable speed drive motors such that the first, second and third variable speed drive motors perform the respective driving functions at speeds that are independently selected to continuously feed strands to the workstation and to cyclically operate and rotate the knitter needles about the center axis at the workstation to form a desired type of spiral knit pattern about the core of hose material as the core of hose material is fed continuously through the workstation.

16. Strand feeding apparatus for receiving strands that pay out from a rotating bank of strand supply packages and for feeding a rotating array of such strands uniformly, evenly and concurrently to a knitter machine workstation that is located along an imaginary center axis about which the bank of strand supply packages rotates, comprising:

a) rotary means including structure for extending substantially concentrically about the center axis for being rotated about the center axis in unison with the rotation of the bank of strand supply packages, for defining at least portions of an array of separate feedpaths along which strands that are payed out from the strand supply packages are to be fed in traveling from the bank of supply packages to the knitter machine workstation;

b) positive drive means including a plurality of positive drive units that are connected to said structure for rotation therewith about the center axis, with each of the positive drive units being located along a separate one of the strand feedpaths, with each of the positive drive units including a capstan that is rotatable relative to said structure about a separate capstan axis, and with each of the capstans defining a generally cylindrical strand receiving formation that is associated with a separate one of the strand feedpaths by being positioned along the associated strand feedpath and by receiving a taut wrapping of a strand that is fed along the associated feedpath; and, c) capstan rotation means for rotating the capstans about the respective capstan axes, in unison, to effect uniform, even and concurrent feeding of strand reaches that extend from each of the capstans to the workstation by driving all of the capstans in unison and without slippage of the strand wrappings about the associated strand receiving formations of the capstans.

17. The apparatus of claim 16 wherein said structure for extending substantially concentrically about the center axis includes annular plate means for extending substantially perpendicular to the center axis and for mounting the positive drive units such that the capstan axes of the positive drive units extend substantially parallel to the center axis.

18. A knitter machine for supplying a rotating array of strands of material such as yarn to a workstation where the strands are knitted to form a substantially continuous jacket of reinforcing material about a hose core that is fed substantially continuously to and through the workstation, comprising:

a) frame means including upstanding structure for being positioned atop a support surface, for providing opposed first and second upstanding end assemblies that are spaced apart and rigidly interconnected by upper and lower frame members that extend, respectively, above and below a center axis of the machine that passes substantially centrally through first and second aligned openings that are defined by the first and second opposed end assemblies, respectively;

b) tubular means extending substantially concentrically about the center axis and having first and second opposed end regions located near the first and second opposed end assemblies, with the tubular means being connected to the frame means for rotation relative thereto about the center axis, with the first end region defining an opening through which a supply of hose core material can be fed while traveling substantially along the center axis, and with a workstation of the knitter machine being defined near the second end region of the tubular means, to and through which the hose core material moves during operation of the knitter machine;

c) knitter means connected to the tubular means near one of the opposed end regions thereof and including a plurality of knitter needles that extend into the workstation of the knitter machine and that execute stroking movements in response to selected rotary movement of the tubular means about the center axis for knitting a plurality of strands of material such as yarn that are supplied to the workstation to form a substantially continuous knit jacket of reinforcing material about portions of the hose core as such portions pass through the workstation during operation of the knitter machine;

d) strand supply package support means connected to the tubular means for receiving at least one bank of strand supply packages and for rotating the bank of strand supply packages about the center axis while permitting strands of material such as yarn to be payed out from the supply packages and for being fed along separate feedpaths to the workstation during operation of the knitter machine;

e) strand feeding means for receiving strands that are payed out from the rotating bank of strand supply packages, and for feeding a rotating array of such strands uniformly, evenly and concurrently to the workstation during operation of the machine, including:

i) annular mounting means for extending substantially concentrically about the center axis at a location substantially adjacent the workstation, for being connected to the tubular means for rotation therewith about the center axis in concert with the rotation of the strand supply package support means about the center axis, and for defining at least portions of an array of separate feedpaths along which strands that are payed out from the strand supply packages are to be fed in traveling from the bank of supply packages to the workstation;

ii) positive drive means including a plurality of positive drive units that are connected to said annular mounting means for rotation therewith about the center axis, with each of the positive drive units being located along a separate one of the strand feedpaths, with each of the positive drive units including a capstan that is rotatable relative to said structure about a separate capstan axis, and with each of the capstans defining a generally cylindrical strand receiving formation that is associated with a separate one of the strand feedpaths by being positioned along the associated strand feedpath and by receiving a taut wrapping of a strand that is fed along the associated feedpath; and, iii) capstan rotation means for rotating the capstans about the respective capstan axes, in unison, to effect uniform, even and concurrent feeding of strand reaches that extend from each of the capstans to the workstation by driving all of the capstans in unison and without slippage of the strand wrappings about the associated strand receiving formations of the capstans.

19. The apparatus of claim 18 said annular mounting means includes annular plate means for extending substantially perpendicular to the center axis and for mounting the positive drive units such that the capstan axes of the positive drive units extend substantially parallel to the center axis.

20. The apparatus of claim 16 wherein the capstan rotation means includes first flexible drive means for drivingly interconnecting all of the capstans for concurrent rotation about the respective capstan axes, and second flexible drive means for drivingly interconnecting at least some of the capstans with a source of rotary motion for rotating the capstans to effect positive feeding of the strands along the feedpaths to the workstation.

21. The apparatus of claim 20 wherein the first and second flexible drive means comprise first and second positive drive belts that engage separate toothed drive pulley tracks that are provided on each of the capstans.

22. The apparatus of claim 21 wherein the first positive drive belt is engaged by idler means that are rotatably connected to the annular plate means at locations situated between selected adjacent pairs of the first toothed drive pulley tracks for causing the first positive drive belt to be reeved around the adjacent pairs of drive pulley tracks for greater reaches of distance than would be the case if the first positive drive belt were simply reeved in a circumferentially extending manner about the substantially circular array of first toothed drive pulley tracks.

23. The apparatus of claim 21 wherein the second positive drive belt is reeved in a circumferentially extending manner about the substantially circular array of second toothed drive pulley tracks except where a reach of the second positive drive belt extends away from the array of second toothed drive pulley tracks and is reeved around a drive pulley that is rotated by said source of rotary motion.

24. The apparatus of claim 22 wherein the capstan rotation means includes first flexible drive means for drivingly interconnecting all of the capstans for concurrent rotation about the respective capstan axes, and second flexible drive means for drivingly interconnecting at least some of the capstans with a source of rotary motion for rotating the capstans to effect positive feeding of the strands along the feedpaths to the workstation.

25. The apparatus of claim 24 wherein the first and second flexible drive means comprise first and second positive drive belts that engage separate toothed drive pulley tracks that are provided on each of the capstans.

26. The apparatus of claim 18 wherein:

a) the tubular means includes a first tubular structure that extends substantially concentrically about the center axis and substantially continuously along the center axis from a first end region thereof that is located near the first upstanding end assembly to a second end region thereof that is located near the second upstanding end assembly and adjacent the workstation, with the first tubular structure being supported by the frame means for rotation relative thereto about the center axis, and with the first end region of the first tubular structure being provided with first drive connection means for receiving a first flexible endless drive member for rotating the first tubular structure about the center axis;

b) the tubular means additionally includes a second tubular structure that extends concentrically about the center axis and about the first tubular structure so as to substantially continuously surround the first tubular structure along substantially the full length of the space that extends between the first and second upstanding end assemblies, with the second tubular structure having a first end region located near the first upstanding end assembly but spaced from the first drive connection means, with the second tubular structure having a second end region located near the second upstanding end member, with the second tubular structure being supported by the frame means for rotation relative thereto and relative to the first tubular structure about the center axis, and with the second end region of the second tubular structure being provided with second drive connection means for receiving a second flexible endless drive member for rotating the second tubular structure about the center axis;

c) the knitter means includes first and second relatively rotatable components that cooperate to support and movably mount a set of knitter needles that are adapted to engage and knit a plurality of strands that are delivered to the workstation to form a spiral knit pattern about a core of hose material that is fed substantially continuously to and through the workstation when the knitter machine is in operation, with the first relatively rotatable component being drivingly connected to and supported by the first tubular structure, with the second relatively rotatable component being drivingly connected to and supported by the second tubular structure, and with the knitter means being operative in response to relative rotation of the first and second tubular structures to cyclically move said set of knitter needles so as to knit a spiral knit pattern about a core of hose material that is fed substantially continuously to and through the workstation when the knitter machine is in operation;

d) first variable speed drive means is provided including a first variable speed drive motor and a first flexible endless drive member that drivingly connects an output shaft of the first variable speed drive motor and the first drive connection means for rotating the first tubular structure about the central axis relative to the frame structure;

e) second variable speed drive means is provided including a second variable speed drive motor and a second flexible endless drive member that drivingly connects an output shaft of the second variable speed drive motor and the second drive connection means for rotating the second tubular structure about the central axis relative to the frame structure;

f) the capstan rotation means includes a third variable speed drive motor and a third flexible endless drive member that drivingly connects an output shaft of the third variable speed drive motor and the capstans to effect rotation of the capstans about the respective capstan axes, in unison, to effect uniform, even and concurrent feeding of said strands to the workstation for being knitted at the workstation to form a spiral knit pattern in a jacket of strand material that is tautly formed about a core of hose material that is fed substantially continuously to and through the workstation when the knitter machine is in operation;

g) whereby the character of the spiral knit pattern that is formed in the jacket of strand material that is tautly formed about the core of hose material at the workstation can be controlled by controlling the relative speeds of operation of the first, second and third variable speed drive motors.

27. The apparatus of claim 26 wherein, during operation of the knitter machine, the first and second variable speed drive motors are operated at relative speeds that are selected to cause the knitter needles to execute a stroke rate at the workstation that is within the range of about 3000 to about 6000 cycles per minute.

28. The apparatus of claims 26 and 27 wherein, during operation of the knitter machine, the second variable speed drive motor is operated at a speed that is selected to cause the rotating array of feedpaths to rotate relative to the frame structure at a speed that is within the range of about 600 to about 1400 revolutions per minute.

29. Apparatus for feeding a plurality of strands of material such as yarn, in unison, along an array of separate feedpaths that extend from a bank of supply packages to a workstation of a knitter machine while such structure as defines the array of separate feedpaths rotates about an imaginary center axis that extends substantially centrally through the workstation, and wherein:

a) capstan means is provided that includes an array of capstan assemblies that each are associated with a separate one of the feedpaths for drivingly engaging an associated strand that is fed along the associated feed path, and that each have bearing means connected to such structure as defines the array of separate feedpaths for rotation with such structure about the center axis, with each of the bearing means defining an associated capstan axis;

b) each of the capstan assemblies includes a capstan that is journalled by the associated bearing means for rotation about the associated capstan axis relative to such structure as defines the array of separate feedpaths;

c) each of the capstans defines an associated strand engaging formation means that extends near the associated feedpath for receiving a wrapping of the associated strand and for effecting positive feeding of the associated strand along the associated feedpath in response to rotation of the associated capstan about the associated capstan axis; and, d) capstan rotation means is provided for drivingly interconnecting all of the capstans for concurrent rotation about the respective capstan axes, and for drivingly connecting at least some of the capstans to a source of rotary motion for effecting concurrent rotation of the capstans, in unison, about the respective capstan axes during operation of the knitter machine to feed said plurality of strands uniformly, evenly and concurrently along the array of separate feedpaths to the workstation.

* * * * *